US005337445A

United States Patent [19]

Harris et al.

[11] Patent Number: 5,337,445

[45] Date of Patent: Aug. 16, 1994

[54] VACUUM FAN DUSTER

[75] Inventors: Gregory Harris, Nashville, Tenn.; Roy V. Nicholson, Hickory, N.C.; Stephen R. Burns, Duluth, Ga.; Robert W. Lackey, Hickory, N.C.

[73] Assignee: Robert W. Lackey Corporation, Hickory, N.C.

[21] Appl. No.: 68,429

[22] Filed: May 27, 1993

Related U.S. Application Data

[63] Continuation of Ser. No. 864,625, Apr. 7, 1992, Pat. No. 5,235,722.

[51] Int. Cl.[5] ..... A47L 9/06

[52] U.S. Cl. ..... 15/394; 15/410; 15/398

[58] Field of Search ..... 15/394, 398, 410

[56] References Cited

U.S. PATENT DOCUMENTS

| | | | |
|---|---|---|---|
| D. 296,022 | 5/1988 | Restivo | D32/51 |
| 1,669,302 | 5/1928 | Lanman . | |
| 2,231,802 | 2/1941 | Diggs . | |
| 2,271,694 | 2/1942 | Johnson . | |
| 2,277,444 | 3/1942 | McPhee . | |
| 2,490,892 | 12/1949 | Westhoff . | |
| 2,599,420 | 6/1952 | Westhoff et al. | 15/394 |
| 2,611,917 | 9/1952 | Ventsias et al. . | |
| 2,652,583 | 9/1953 | Tomanica . | |
| 2,659,924 | 11/1953 | Forsoberg . | |
| 2,804,640 | 9/1957 | Zaidan | 15/394 |
| 4,638,526 | 1/1987 | Murata et al. . | |
| 4,653,137 | 3/1988 | Fleischhauer . | |
| 4,718,141 | 1/1988 | Kuehnl . | |
| 4,787,118 | 11/1988 | Weiland et al. . | |
| 4,823,431 | 4/1989 | Carpenter | 15/394 |

FOREIGN PATENT DOCUMENTS

| | | |
|---|---|---|
| 160686 | 1/1955 | Australia . |

*Primary Examiner*—Chris K. Moore

*Attorney, Agent, or Firm*—Hardaway Law Firm

[57] ABSTRACT

A vacuum assisted apparatus for cleaning the surfaces of a ceiling fan blade having a unitary housing defining a brush-lined aperture and having a dust receptacle for catching dust displaced by the brushes.

3 Claims, 1 Drawing Sheet

FIG. 1
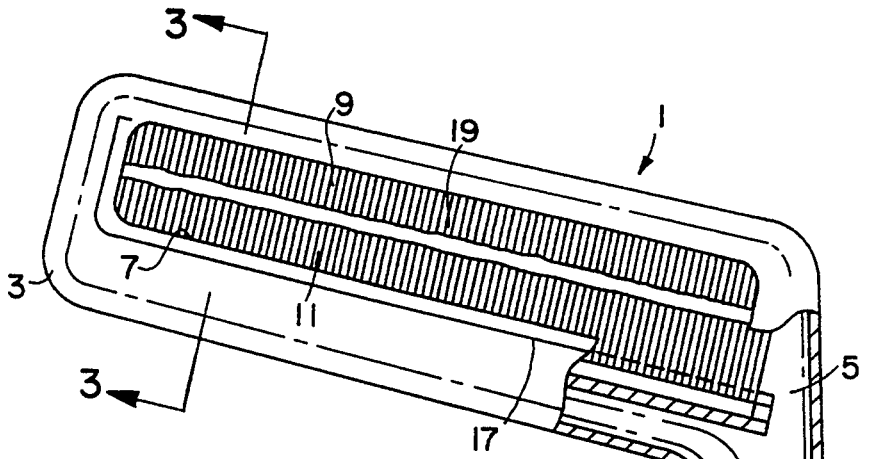
FIG. 2
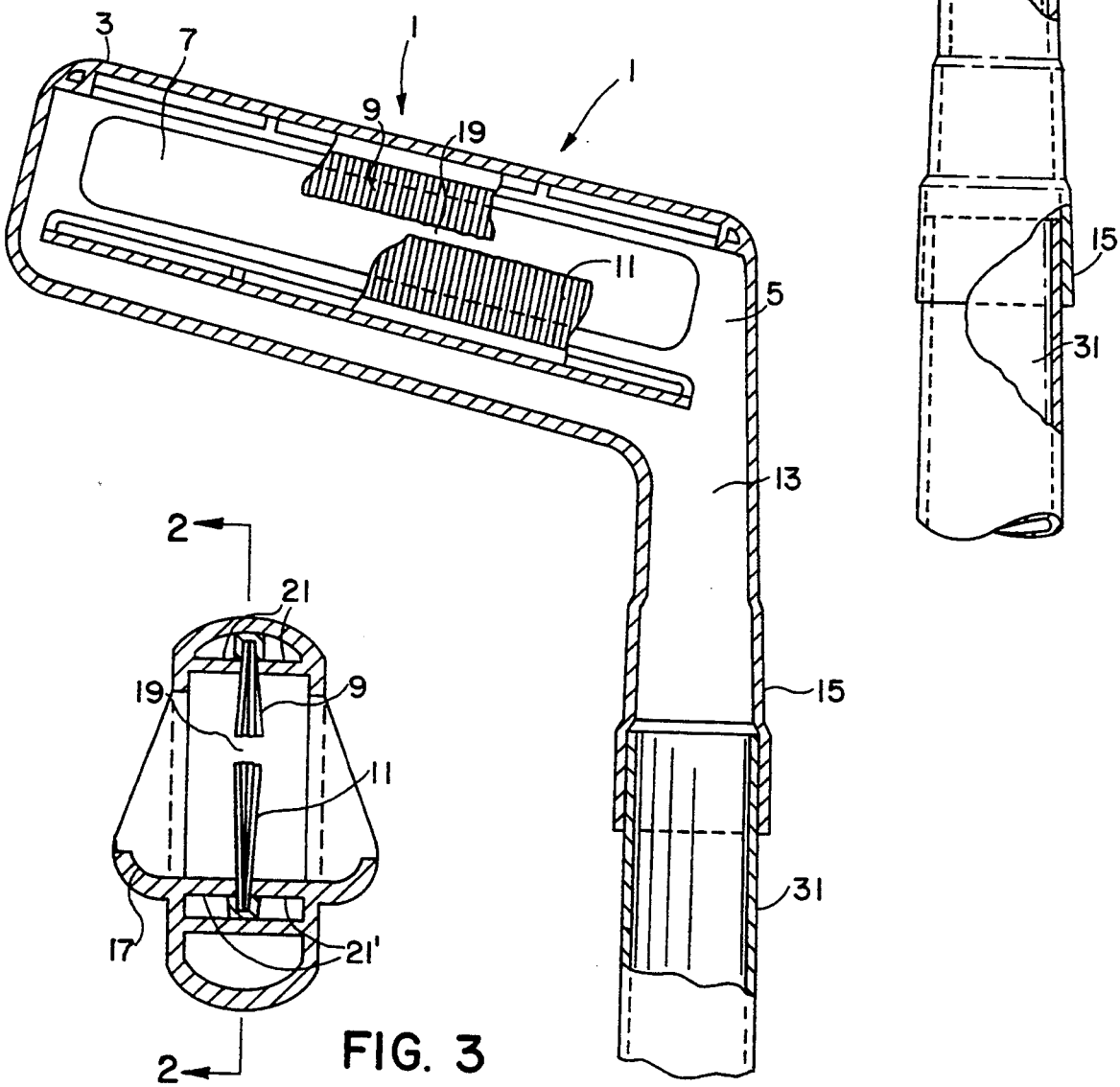
FIG. 3

VACUUM FAN DUSTER

This application is a continuation of Ser. No. 864,625, filed Apr. 7, 1992, now U.S. Pat. No. 5,235,722.

BACKGROUND OF THE INVENTION

This invention relates generally to the art of cleaning devices and, more particularly, to an apparatus for cleaning ceiling fan blades.

While there are a variety of apparatuses which can be employed to clean a fan blade, these implements are generally unsatisfactory for safe, rapid and efficient cleaning of ceiling fan blades. Current cleaning aids are generally ill-suited for cleaning the upper surface of the ceiling fan blade, forcing the user to use a ladder or stool to reach the upper plate surfaces. Other cleaning tools are heavy, bulky attachments which limit the reach and mobility of the cleaning device or which require the user to employ an awkward position. The present invention allows the user to easily clean the surfaces of a ceiling fan blade while remaining safely at ground level. The apparatus can safely clean a variety of blade shapes, sizes and materials. Further, the apparatus has an effective unitary construction and facilitates the cleaning process.

Various cleaning apparatuses and their method's construction are known and found in the prior art. U.S. Pat. No. 3,110,923 to Berlime shows an attachment for vacuum cleaning venetian blind slats. However, Berlime's apparatus does not provide a mechanism for securely engaging ceiling fan blades. As such, the blades continue to rotate while being cleaned. Berlime also discloses the use of a vacuum source to remove accumulated dust. Berlime does not provide a dust receptacle for catching and storing displaced dust. Carpenter, in U.S. Pat. No. 4,823,431, discloses a fan blade cleaning apparatus which securely engages the fan blade and employs a vacuum. However, Carpenter's apparatus permits any displaced dust to fall onto the floor or furnishings. In addition, Carpenter teaches a vacuum housing which must be assembled with air tight seals.

SUMMARY OF THE INVENTION

It is thus an object of the present invention to provide an improved means for safely cleaning the surfaces of a ceiling fan blade which employs a vacuum.

It is a further object of the invention to provide a vacuum assisted cleaning apparatus for cleaning the surfaces of the ceiling fan blade which provides a dust receptacle for capturing displaced dust that is not initially picked up by the vacuum.

BRIEF DESCRIPTION OF THE DRAWINGS

FIG. 1 is a perspective view in partial phantom of the vacuum fan duster apparatus showing a slightly angled tilt to accommodate the pitch of ceiling fan blades.

FIG. 2 is a sectional view of the apparatus as seen in FIG. 1.

FIG. 3 is a transverse section of the apparatus taken along line 3—3 as seen in FIG. 1.

DETAILED DESCRIPTION

According to this invention, it has been found that a vacuum assisted ceiling fan blade cleaning apparatus can be provided which has a unitary housing defining a brush-lined engaging aperture, a dust retaining receptacle, and a hollow neck along a side of the housing connecting the housing to a vacuum source.

As seen in FIG. 1, a blade cleaning attachment 1 has a molded housing 3 defining an air chamber 5 and a blade aperture 7 traversing the width of the housing. Aperture 7 is in communication with air chamber 5 and has a first upper brush 9 and a second lower brush 11 in an opposite spaced alignment. As best seen in FIG. 3, brushes 9 and 11 are each suspended from separate pairs of spaced arms 21 and 21', projecting from the housing 3, which grip the base of the respective brushes. Additional support to the brush base is furnished by the interior surface walls of housing 3.

As best seen in FIGS. 1 and 2, a hollow neck 13 is further defined by a side of the housing. The interior of neck 13 is in communication with air chamber 5 and furnishes an attachment means of connecting apparatus 1 to a vacuum source via opening 15. Ideally, neck 13 and opening 15 are configured to adapt to a wand 31 of a standard home vacuum unit.

A dust receptacle 17 is also defined by extensions or extended edges or margins of molded housing 3 and is positioned below aperture 7 to collect any dust which might be dislodged by the brushes yet not removed by the accompanying vacuum. This dust receptacle 17 has a substantially horizontal dust collecting surface and at least one up-turned dust retaining surface. It should be noted that by "horizontal" we mean that at least one surface of the dust receptacle is either actually horizontal or can have a horizontal tangent. Dust receptacle 17 is in communication with air chamber 5 and neck 13 to facilitate the removal of any accumulated dust. Ideally, brushes 9 and 11 have a tight pattern of bristles which cover the majority of aperture 7, leaving only a small brush gap 19 between the brushes through which a fan blade can be inserted. This arrangement ensures a firm engagement of the fan blade, thereby cleaning all sides of the blade. In addition, this arrangement concentrates the volume of air flow about the bristle tips of the brushes, thereby increasing the amount of dust which is removed by the air flow.

The position of neck 13 to one side of housing 3 enables the user to easily engage the fan blade while maintaining an unobstructed view of the work environment. A centrally mounted handle is less desirable since it tends to obstruct the user's view and could result in accidental damage to the ceiling fan unit. In the preferred embodiment as seen in FIG. 1, neck 13 connects to housing 3 in such a way that the vacuum fan duster apparatus is projected at an approximately 12° angled tilt to correspond with the pitch of typical ceiling fan blades. The angled head gives the user a vertical or plumb reference for the wand 31 while cleaning the blades.

It is thus seen that in accordance with this invention a vacuum assisted ceiling fan blade apparatus is provided which is easily maneuvered and has a unitary housing, an air chamber, a dust receptacle and an offset neck which connects the apparatus to a vacuum source. As variations will become apparent to those of skill in the art from a reading of the above description, such variations are embodied within the spirit and scope of the invention as defined by the following appended claims.

We claim:

1. A vacuum assisted ceiling fan cleaner comprising:

a molded housing defining an air chamber and having an attachment means for connecting said housing to a vacuum source so as to produce a negative air flow;

said molded housing having upper and lower halves, said upper and lower halves supporting upper and lower cleaning surfaces, respectively, and said upper and lower halves being fixed to each other; and said upper and lower cleaning surfaces of said housing defining a gap of a fixed thickness therebetween for the insertion of the ceiling fan blade, an end of said attaching means is mounted with respect to said gap so as to cause substantially equal amounts of negative air flow to contact a top and a bottom of a ceiling fan blade.

2. The device according to claim 1 wherein at least a portion of said negative air flow is applied to said gap in a direction substantially parallel to said upper and lower cleaning surfaces.

3. The device according to claim 1 further comprising a dust receptacle provided beneath said gap and said dust receptacle is in direct communication with said negative air flow.

* * * * *